United States Patent [19]

Attaway

[11] 3,974,609

[45] Aug. 17, 1976

[54] EXPANSION JOINT COVER

[75] Inventor: Julian J. Attaway, Tucker, Ga.

[73] Assignee: MM Systems Corporation, Tucker, Ga.

[22] Filed: July 16, 1975

[21] Appl. No.: 596,271

[52] U.S. Cl. ..... 52/273; 52/396; 404/68; 14/16.5

[51] Int. Cl.[2] ..... E04B 1/66

[58] Field of Search ..... 14/16 J; 404/47, 68; 52/393, 395, 396, 402, 403, 273, 573

[56] References Cited

UNITED STATES PATENTS

| | | | |
|---|---|---|---|
| 2,331,140 | 10/1943 | Schmidt | 52/573 |
| 3,344,720 | 10/1967 | Hallock | 404/47 |
| 3,390,501 | 7/1968 | Driggers | 404/47 |
| 3,435,574 | 4/1969 | Hallock | 52/396 |
| 3,474,589 | 10/1969 | Cheatwood | 52/288 |
| 3,520,096 | 7/1970 | Kilcher | 52/396 |
| 3,527,009 | 9/1970 | Nyquist | 52/288 |
| 3,790,294 | 2/1974 | Trieste | 404/68 |
| 3,849,958 | 11/1974 | Balzer | 52/396 |

*Primary Examiner*—Ernest R. Purser
*Assistant Examiner*—William Randolph
*Attorney, Agent, or Firm*—John B. Armentrout

[57] ABSTRACT

An expansion joint cover for sealing off a space between first and second structural bodies is provided, and includes, first and second side members, and bridging and elastomeric sealing means, the latter means comprising, bridging plate means resting slidably upon an inner ledge wall portion of the first side member and further resting against the second side member so as to form a bottom wall of a cavity bordered by the first and second side members. The bridging plate means is covered by bond-inhibitor means in the cavity and is provided with anchor means projecting into the cavity. An elastomeric sealing member embedding the anchor means and substantially filling the cavity is characterized by being formed and cured in the cavity and thereby being bonded to the first and second side members and inhibited against bonding to the bridging plate means by the bond-inhibitor means.

18 Claims, 6 Drawing Figures

Fig. 2
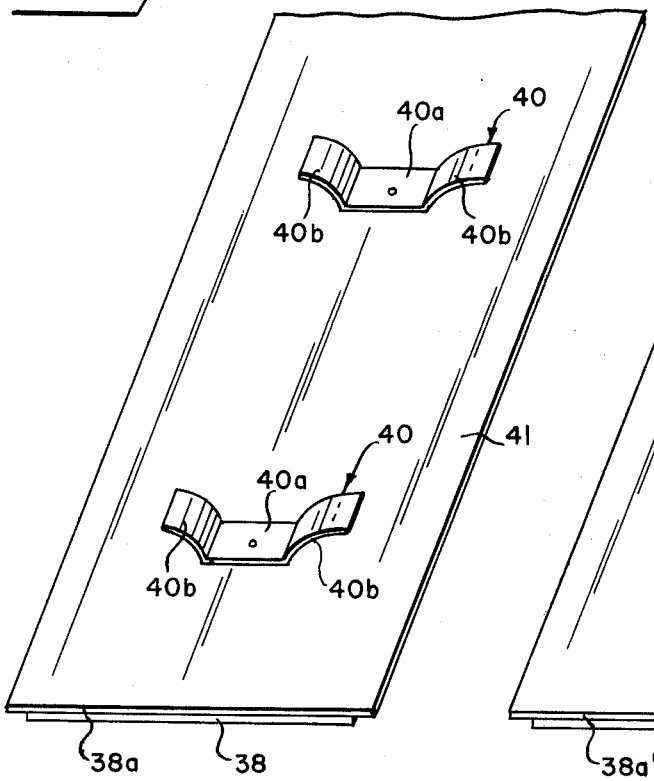
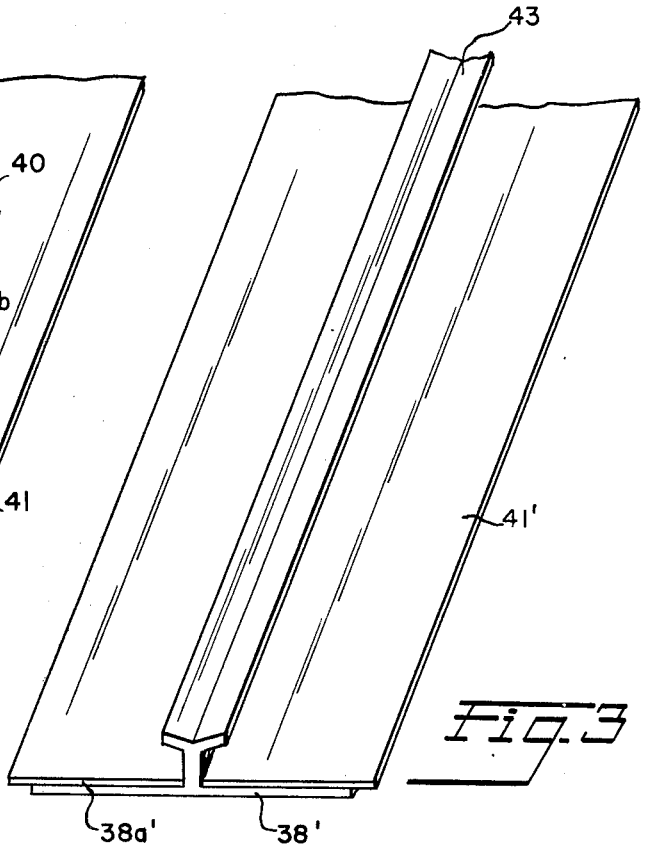
Fig. 3
Fig. 6
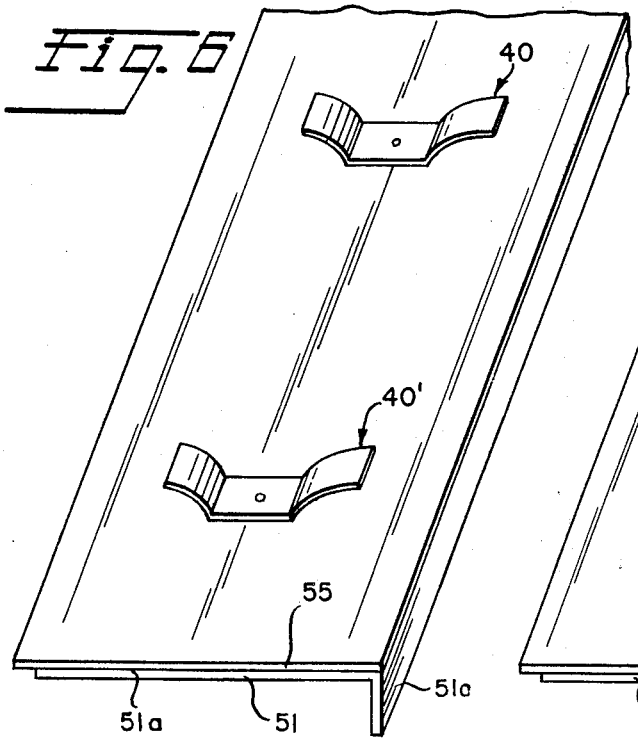
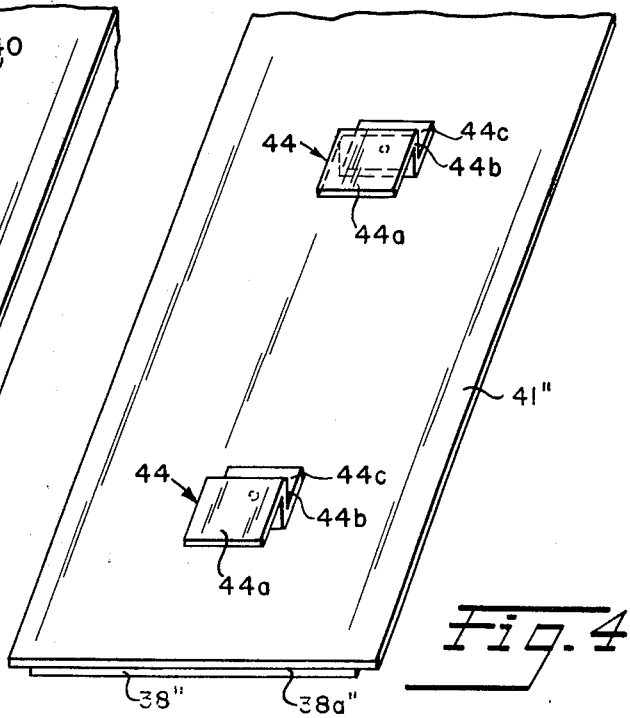
Fig. 4

EXPANSION JOINT COVER

This invention relates to structural joints and more particularly is concerned with covers which are adapted to close off a region between structural bodies that are prone to expand and contract.

As conducive to a better understanding of certain features of the present invention, reference is had to practices in the prior art of the construction field which involve the introduction of intermediate zones, known as expansion joints, between structural bodies, to allow for expansion and contraction of the bodies due to thermal change. The expansion joint or space appearing between the bodies, such as between floor or wall sections of a building, or between a floor and a wall of a building, or between sections of an outdoor pavement, or otherwise, tolerates the relative movement of the bodies or sections. Numerous types of expansion joint covers have been used for closing off the intermediate zone or space between the structural bodies and to permit relative movement of the bodies.

Certain of the expansion joint covers heretofore known afford side members which are joined to the structural bodies at the expansion joint, and the side members support elastomeric means for the latter to extend across the expansion joint and thus cover the joint elastically; however, some of the expansion joint covers of this general type heretofore known fall short of being practical to produce or to install, while others after being installed prove to be inadequate in kind to be maintained on the market competitively.

An object of the present invention, accordingly, is to provide reliable, commercially competitive expansion joint covers which are practical to produce and install and wherein an elastomeric joining substance for side members of the cover is introduced to be in an expansion joint elastically.

Another object of this invention is that of providing expansion joint covers of the character indicated wherein an elastomeric joining substance for side members of the expansion joint cover is interrelated with the side members and with bridging plate and anchor means in a worthwhile manner to facilitate elastic action of the elastomeric substance and control position of the bridging plate means during use of the cover.

Another object of the present invention is the provision of an expansion joint cover which is characterized by first and second side members, by bridging plate means having anchor means thereon, and by elastomeric sealing means molded and cured to bond the first and second side members together and embed the anchor means, having the elastomeric sealing means inhibited against bonding to the bridging plate means.

Another object herein is to provide an expansion joint cover wherein elastomeric sealing means cast and cured to achieve seal and to receive load applied externally, is supported by bridging plate means with having the bridging plate means provided with anchor means embedded in the elastomeric sealing means, and wherein the elastomeric sealing means nevertheless is substantially free at interface with the bridging plate means for being stretched and to contract.

Other objects of this invention in part will be obvious and in part pointed out more fully hereinafter.

In accordance with the present invention an expansion joint cover is provided for sealing off a space between first and second structural bodies and includes, first and second side members, and bridging and elastomeric sealing means. The first and second side members, being for example metallic extrusions such as of aluminum alloy, are adapted to be connected with the first and second structural bodies, respectively, adjacent to the space between the structural bodies. The first side member comprises wall structure including an inner ledge wall portion having an end adapted to be within the space between the aforementioned structural bodies. An outer wall portion of the first side member is adapted to be adjacent to a face of the first structural body defined outside the space, and an intermediate wall portion of the first side member interconnects the ledge wall portion and the outer wall portion.

The bridging and elastomeric sealing means referred to comprises bridging plate means, spaced endwise from the intermediate wall portion of the first side member of the joint cover, and resting slidably upon the inner ledge wall portion of that first side member and against the second side member, so as to form a bottom wall of a cavity bordered by the first and second side members and be movable with clearance with reference to the intermediate wall portion of the first side member. Further, the bridging and elastomeric sealing means includes anchor means connected with the bridging plate means and projecting into the cavity, and an elastomeric sealing member. Bond-inhibitor means covers the bridging plate means in the cavity, and the elastomeric sealing member is molded and cured in situ in the cavity, substantially filling the cavity, and furthermore the elastomeric sealing member is bonded, by molding, to the first and second side members, and embeds the anchor means, and as molded is inhibited against bonding interfacially to the bridging plate means by the bond-inhibitor means.

Accordingly, an expansion joint cover thus provided includes a sealing member of elastomeric material molded and cured in situ against the first and second side members of the cover, to bond those members together, though the elastomeric material is inhibited against bonding at interface with the bridging plate means and is substantially free as cured to be stretched and to contract relatively to the bridging plate means which is supported on the first and second side members of the expansion joint cover. The anchor means, being embedded in the elastomeric sealing member as formed, serves to connect the bridging plate means with the elastomeric sealing member for such purposes as to prevent dropping out of the bridging plate means should the expansion joint open up wider than designed width.

The accompanying drawings include selected views in illustration, and not limitation, of certain embodiments of the present invention, in which:

FIG. 2 is a broken-away isometric detail view of bridging plate, anchor and bond-inhibitor means occurring in FIG. 1;

FIG. 3 is a fragmentary isometric view of a modified form of bridging plate, anchor and bond-inhibitor means;

FIG. 4 is a broken-away isometric view of a further modified bridging plate, anchor and bond-inhibitor means;

FIG. 6 is a broken-away isometric representation of bridging plate, anchor and bond-inhibitor means occurring in FIG. 5.

Figure 1:
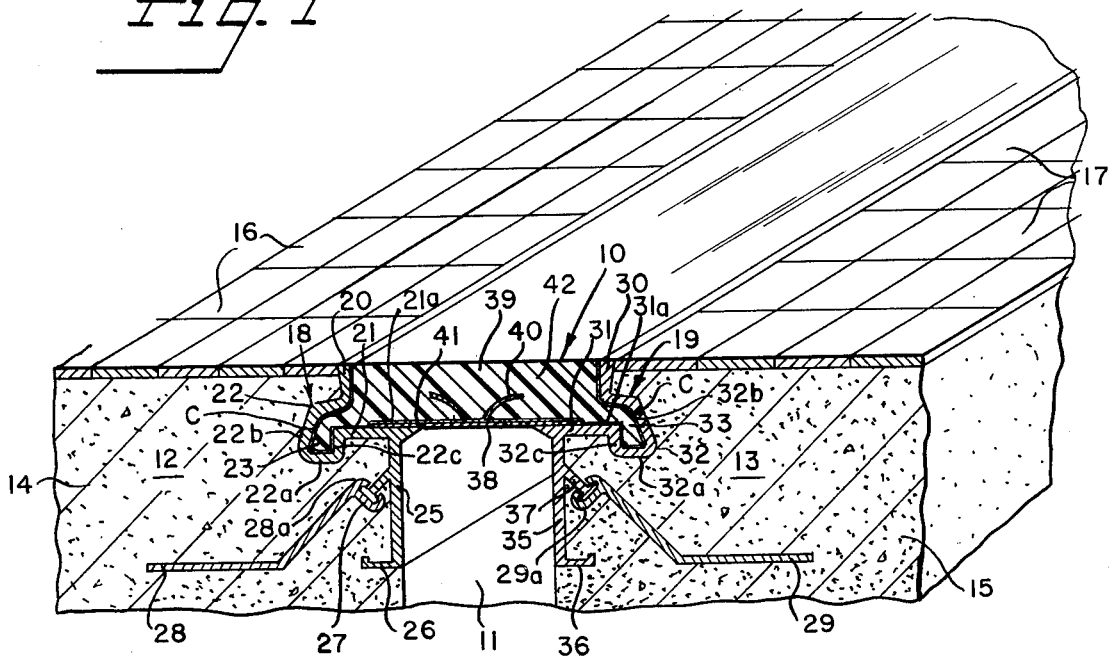
FIG. 1 is a fragmentary isometric view of an expansion joint cover installed in an expansion joint, the figure frontally being representative of the installation in vertical cross sectional elevation.

Referring now more particularly to the embodiment of the present invention represented in FIGS. 1 and 2, an expansion joint cover 10, which is installed for covering an expansion joint 11, is associated with two structural bodies 12 and 13 between which the joint 11 occurs in a building floor. The structural bodies 12 and 13 are comprised of a pair of concrete slabs 14 and 15, and also include block tile checkerworks 16 and 17 covering those slabs and having the tiles suitably secured as by mastic to the slabs for the outside faces of the tiles to contribute visible floor surface in the building.

A pair of side members 18 and 19 of the expansion joint cover 10 are embedded in end portions of the concrete slabs 14 and 15 next to the expansion joint 11 and are similarly constructed, being for example aluminum alloy extrusions from the same or a similar die. The first side member 18, which is integral with the concrete slab 14 through having the concrete of that slab bonded by casting thereto and setting in situ, comprises wall structure, wherein an outer wall portion 20, comprises, a structural component which is substantially flush with the outside surface of the block tile checkerwork 16, and an inner ledge wall portion 21 having a first end adjacent to the expansion joint 11 and being interconnected adjacent to a second end with the outer wall portion 20 by means of an intermediate wall portion 22 of the wall structure of the first side member 18.

A bight wall component 22*a* of the intermediate wall portion 22 interconnects leg components 22*b* and 22*c* of the intermediate wall portion 22, the leg component 22*c* having juncture with the inner ledge wall portion 21 adjacent to the second end of the latter. A bearing surface 21*a* of the inner ledge wall portion 21 lies substantially in a plane, which is parallel to the outside surface of the block tile checkerwork 16 of the structural body 12 and intersects leg component 22*b* of the intermediate wall portion 22, the latter wall portion defining a recess 23 which opens from the bight component 22*a* outwardly between leg components 22*b* and 22*c* toward that same plane. The leg component 22*b* converges upon the leg component 22*c* leading toward the latter plane, and the recess 23, inwardly being relatively wide, reduces in width leading from the bight component 22*a* toward a constriction which is introduced by leg component 22*b* with the second end of the inner ledge portion 21.

The wall structure of the first side member 18 further includes an inner facial wall portion 25, a flange wall portion 26 and a wall connector portion 27. The inner facial wall portion 25 interconnects the flange wall portion 26 with the inner ledge wall portion 21, the connection with the inner ledge wall portion 21 being adjacent to the first end of the latter, and the inner facial wall portion 25 affords wall structure flanking an end of the concrete slab 14 inside the expansion joint 11 while the flange wall portion 26 is embedded in that slab. The wall connector portion 27 is engaged with fittings 28*a* provided on anchors 28, which anchors are laterally spaced apart from one another longitudinally of the first side member 18 and the expansion joint 11, and are embedded in the concrete slab 14 for anchoring the first side member 18. The anchors 28 are for example aluminum alloy products which have been cut from an extrusion having the cross section of the anchors.

The side members 18 and 19, though similar, are reversed with reference to each other, and thus the second side member 19, after being installed, provides an inner facial wall portion 35 flanking an end of the concrete slab 15 inside the expansion joint 11 while having a flange wall portion 36 embedded in the slab 15 and interconnected with an inner ledge wall portion 31 by means of the inner facial wall portion 35, the connection with the inner ledge wall portion 31 being adjacent to a first end of that inner ledge wall portion.

Anchors 29, similar to the anchors 28, are spaced apart from one another longitudinally of the second side member 19 and joint 11, and are embedded in the concrete slab 15, with their fittings 29*a* engaged with a connector wall portion 37 of the second side member 19 for anchoring the second side member.

An outer wall portion 30 of the second side member 19 comprises a structural component, which is substantially flush with the outside surface of the block tile checkerwork 17, and which is connected with the intermediate wall portion 32 of the second side member 19. A bight wall component 32*a* of the intermediate wall portion 32 interconnects leg components 32*b* and 32*c* of the intermediate wall portion 32, the leg component 32*c* having juncture with the inner ledge wall portion 31 adjacent to a second end of the latter. A bearing surface 31*a* of the inner ledge wall portion 31 lies substantially in the aforementioned plane of the bearing surface 21*a* of the first side member 18 and is approximately parallel to the outside surface of the block checkerworks 16 and 17 of the structural bodies 12 and 13, and this plane intersects the intermediate wall portions 22 and 32. The intermediate wall portion 32 defines a recess 33 which opens from the bight component 32*a* outwardly between leg components 32*b* and 32*c* toward that same plane. The leg component 32*b* converges upon the leg component 32*c* leading toward the latter plane, and the recess 33, being inwardly relatively wide, reduces in width leading from the bight component 32*a* toward a constriction which is introduced by leg component 32*b* with the second end of the inner ledge wall portion 31.

A bridging plate 38, such as of aluminum alloy, steel, hard vinyl substance, or the like, rests slidably upon the bearing surfaces 21*a* and 31*a* of the first and second side members 18 and 19 and comprises a bottom wall of a cavity 39 formed by the bridging plate 38 with the first and second side members 18 and 19. With reference to FIGS. 1 and 2, it will readily be understood that the bridging plate 38 comprises substantially flat wall means. The first and second side members 18 and 19 and the bridging plate lead longitudinally with the expansion joint 11, and the opposite lateral edges of the bridging plate 38 are disposed within the reaches of the bearing surfaces 21*a* and 31*a* to provide lateral clearance of the bridging plate 38 from the opposite inner faces of the intermediate wall portions 22 and 32 longitudinally along the expansion joint 11 and thus to have the cavity 39 reach into and include the recesses 23 and 33.

The bridging plate 38 is equipped with anchor structure which, as will be understood through referring to FIG. 2, includes a plurality of anchor members 40 connected with the bridging plate generally centrally laterally of the bridging plate and spaced apart from one another longitudinally of the bridging plate. Each anchor member 40 in the present embodiment includes a bight portion 40*a* suitably secured to the bridging plate 38, such as by spot welding, and a pair of oppositely inclined arms 40*b* interconnected by the bight portion 40*a* and longitudinally leading laterally of the bridging plate upwardly and outwardly in the cavity 39 from the bridging plate. The arms 40*b* of the anchors 40 are proportioned to have a reach which terminates inwardly laterally of the bridging plate 38 from the opposite lateral ends of the bridging plate, and preferably terminates along approximately the inner lateral one-third of the bridging plate.

The first and second side members 18 and 19 are characterized by having a bond-promoting primer coating C and C′ thereon in the cavity 39. The substantially flat surface 38*a* of the bridging plate 38 next to the cavity 39, and preferably those portions of the bearing surfaces 21*a* and 31*a* of the side members 18 and 19 not overlapped by the bridging plate, are covered by any suitable bond-inhibitor means 41, such as tape which is weakly adhered to the face 38*a* and to the surfaces 21*a* and 31*a*. An elastomeric sealing member 42 is produced, either before or after the first and second side members 18 and 19 are installed, by casting and curing an elastomeric material in the cavity 39 so as to embed the anchor members 40 and fill the cavity substantially up to approximately flush with the outer ends of the outer wall portions 20 and 30 of the first and second side members, thereafter having the elastomeric material cure and bond to the coatings C and C′ on the side members 18 and 19 inside the cavity and be inhibited against bonding to the surface 38*a* of the bridging plate 38 and the adjacent surfaces 21*a* and 31*a* by the bond-inhibitor means 41.

Accordingly, the cured elastomeric sealing member 42 affords a tight seal closing the joint 11, and although bonded to the first and second side members 18 and 19, the elastomeric sealing member can move freely at the interface with reference to the bridging plate 38 while elastically responding to movement of the first and second side members 18 and 19 with the structural bodies 12 and 13. During stretch, the elastomeric sealing member 42 bonded to the first and second side members 18 and 19 is further retained by being held by those side members as configurated in the recesses 23 and 33. The bridging plate 38 is controlled as to position through being anchored and thus connected with the elastomeric sealing member 42 by the anchors 40. Anchors 40 arrest shift of the bridging plate 38 relatively to the elastomeric sealing member 42 while the bridging plate 38 and the first and second side members 18 and 19 are sliding relatively at the bearing faces 21*a* and 31*a* and, moreover, the anchors 40 enable position of the bearing plate 38 on the bearing surfaces 21*a* and 31*a* to be restored should the bridging plate 38 escape from either of those surfaces on having the expansion joint 11 open wider beyond expectations and then close.

A modified form of bridging plate, anchor and bond-inhibitor means, represented in FIG. 3, and which may for example be substituted for the bridging plate, anchor and bond-inhibitor means heretofore described, includes a bridging plate 38′ formed as an extrusion along with the anchor means 43, the latter being a laterally generally centrally disposed Y-shaped rib leading longitudinally with the bridging plate 38′. Surface 38*a′* of this same bridging plate is covered by bond-inhibitor means 41′, to inhibit bonding of the material of an elastomeric sealing member to the surface 38*a′*. The Y-shaped rib 43 is proportioned to have a reach laterally which terminates inwardly laterally of the bridging plate 38′ from the opposite lateral ends of the bridging plate and preferably which terminates along approximately the inner lateral one-third of the bridging plate.

As illustrative of a further modified form of bridging plate, anchor and bond-inhibitor means in accordance with the present invention, reference is had to FIG. 4 wherein a bridging plate 38″ carries a plurality of anchor members 44 disposed laterally generally centrally thereof in a relation wherein the anchor members 44 are spaced apart from each other longitudinally of the bridging plate 38″. Each of the anchor members 44 includes an arm 44*a* which extends longitudinally with the bridging plate 38″, an upright portion 44*b*, and a base portion 44*c* resting upon the bridging plate 38″ and suitably secured thereto as by spot welding. In lateral extent, the anchor members are proportioned to have a reach which terminates inwardly laterally of the bridging plate 38″ from the opposite lateral ends of the bridging plate and preferably approximately within the inner lateral one-third of the bridging plate. The surface 38*a″* of the bridging plate is covered by bond-inhibitor means 41″ for a purpose hereinbefore described.

Figure 5:
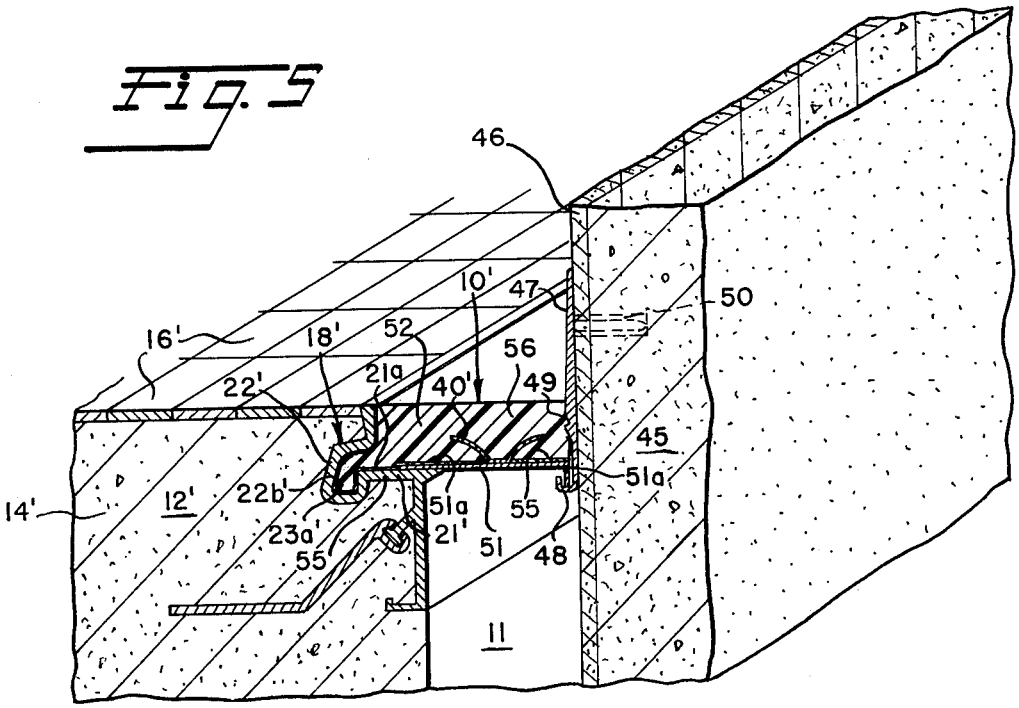
FIG. 5 is a fragmentary isometric view of a modified form of an expansion joint cover and installation and frontally represents the installation in vertical cross-sectional elevation.

An expansion joint cover 10′ for use in association with structural bodies 12′ and 45 is represented installed with those structural bodies in FIG. 5, the structural body 12′ including a building concrete floor slab 14′ and a checkerwork tile covering 16′ secured to the slab. Structural body 45 comprises a wall of the building, such as a masonry partition, which is finished off at 46, and forms an expansion joint 11′ with the structural body 12′. A first side member 18′ of the expansion joint cover 10′ is in all respects similar to the first side member 18 in FIG. 1, and is embedded and anchored in the concrete slab 14′ in a manner hereinbefore described with reference to FIG. 1. A second side member of the expansion joint cover 10′ comprises a longitudinal facia member 47 laterally leading above the level of the structural body 12′ and secured to the structural body 45 by screws and corresponding anchors 50. There is an upwardly open channeled lower end portion 48 of the facia member 47 inside the expansion joint 11′, and the facia member laterally intermediately has a longitudinal groove 49 therein which is laterally entrant from within the expansion joint 11′.

The channeled lower end portion 48 of the facia member 47 is situated at a level for supporting a bridging plate 51 of the expansion joint cover 10′ to be substantially in a plane which is parallel to the top surface of the structural body 12′ and intersects intermediate wall portion 22′ of the first side member 18′, and more particularly the leg component 22*b′* opposite the bearing surface 21*a′* of the inner ledge wall portion 21′. A longitudinal laterally projecting flange 51*a* from one of the opposite lateral ends of the bridging plate 51 engages that plate with member 47 in the channeled lower end portion of the latter to move with the structural body 45, and the plate 51 rests slidably upon the bearing surface 21*a′* of the first side member 18′ and has an end on that bearing surface.

A cavity 52, bordered by the bridging plate 51, by the first side member 18′, and by the facia member 47, extends into the recess 23*a'* in the first side member 18' and into the groove 49 in the facial member 47 and is filled with an elastomeric material which has been molded and cured in the cavity 52 and comprises the elastomeric sealing member 56. The first side member 18' and the facia member 47 have a bond-promoting coating thereon in the cavity 52 and accordingly the elastomeric sealing member 47 has bond therewith, and the bridging plate 51 carries generally centrally laterally disposed and longitudinally spaced anchor members 40' which are similar to those described with reference to FIG. 1. An upper face 51*a* of the bridging plate 51 is covered by bond-inhibitor means 55 having that bond-inhibitor means preferably extend out over the bearing surface 21*a'* for also masking that portion of the bearing surface 21*a'* which is not covered by the bridging plate. Under the conditions of the elastomeric sealing member 56 having been molded and cured in the cavity 52, the elastomeric sealing member resultingly is substantially free of bond to the surface 51*a* of the bridging plate and to that portion of the bearing surface 21*a'* which furthermore is masked by the bond-inhibitor means 55, and the anchor members 40' are securely embedded in the body of the elastomeric sealing member.

As the invention lends itself to many possible embodiments and as many possible changes may be made in the embodiments hereinbefore set forth, it will be distinctly understood that all matter described herein is to be interpreted as illustrative and not as a limitation.

I claim:

1. An expansion joint cover for sealing off a space between first and second structural bodies, said expansion joint cover comprising, first and second side members, and bridging and elastomeric sealing means, said first and second side members being adapted for being secured to first and second structural bodies, respectively, said first side member including wall structure comprising, an intermediate wall portion having first and second leg wall components and a bight wall component interconnecting said first and second leg wall components and there being a recess defined by said first and second leg wall components and said bight wall component, an outer wall portion connected with said first leg wall component and adapted to lead adjacent to an outside face of a first structural body, and an inner ledge wall portion adapted to lead adjacent to a space between first and second structural bodies, an end of said inner ledge wall portion forming a constricted entrance into said recess with said first leg wall component, and there being a bearing surface of said inner ledge wall portion set off across said constricted entrance from said first leg wall component of said intermediate wall portion; and said bridging and elastomeric sealing means including, bridging wall means supported by said first and second side members and forming a cavity with said first and second side members having said cavity commuicate with said recess through said constricted entrance, said bridging wall means having a first end portion resting slidably upon said bearing surface of said inner ledge wall portion in said cavity, and said bridging wall means being covered by bond-inhibitor means in said cavity, and said bridging and elastomeric sealing means further comprising, anchor means connected with said bridging wall means and in said cavity, and an elastomeric sealing member molded and cured in said recess and cavity and bonding said first and second side members together in said cavity and substantially filling said recess and cavity, and embedding said anchor means in said cavity and anchoring to said first side member in said recess through said constricted entrance while being inhibited against bonding to said bridging wall means in said cavity.

2. An expansion joint cover as set forth in claim 1 wherein said bond-inhibitor means extends outside at least said first end portion of said bridging wall means and inhibits bond of said elastomeric sealing member to at least said bearing surface of said inner ledge wall portion of said first side member.

3. An expansion joint cover as set forth in claim 1 wherein said anchor means is connected with said bridging wall means generally centrally laterally of said bridging wall means and in reach, anchoringly, terminates inwardly laterally of said bridging wall means from opposite lateral ends of bridging wall means.

4. An expansion joint cover as set forth in claim 3 wherein reach of said anchor means, anchoringly, laterally terminates along approximately the inner lateral one-third of said bridging wall means.

5. An expansion joint cover as set forth in claim 3 wherein said bond-inhibitor means inhibits bond of said elastomeric sealing member at the bottom of said cavity to substantially flat surface areas of said bridging wall means on said first end portion of said bridging wall means and between said first end portion and a second end portion of said bridging wall means and said anchor means, and said bond-inhibitor means extends outside at least said first end portion of said bridging wall means and inhibits bond of said elastomeric sealing member to at least said bearing surface of said inner ledge wall portion of said first side member.

6. An expansion joint cover as set forth in claim 1 wherein said second side member and a second end portion of said bridging wall means are engaged for said bridging wall means to move with said second side member and be supported by said second side member while said first end portion of said bridging wall means moves slidably upon said bearing surface of said inner ledge wall portion of said first side member.

7. An expansion joint cover as set forth in claim 6 wherein said bond-inhibitor means extends outside said first end portion of said bridging wall means and inhibits bond to said bearing surface of said inner ledge wall portion of said first side member.

8. An expansion joint cover as set forth in claim 6 wherein said bond-inhibitor means inhibits bond of said elastomeric sealing member at the bottom of said cavity to substantially flat surface areas of said bridging wall means on said first end portion of said bridging wall means and between said first and second end portions of said bridging wall means and said anchor means, and said bond-inhibitor means extends outside said first end portion of said bridging wall means and inhibits bond of said elastomeric sealing member to said bearing surface of said inner ledge wall portion of said first side member.

9. An expansion joint cover as set forth in claim 8 wherein said anchor means is connected with said bridging wall means generally centrally laterally of said bridging wall means and in reach, anchoringly, terminates inwardly laterally of said bridging wall means from opposite lateral ends of said bridging wall means.

10. An expansion joint cover as set forth in claim 9 wherein reach of said anchor means, anchoringly, laterally terminates along approximately the inner lateral one-third of said bridging wall means.

11. An expansion joint cover for sealing off a space between first and second structural bodies, said expansion joint cover comprising, first and second side members, and bridging and elastomeric sealing means, said first and second side members being adapted for being secured to first and second structural bodies, respectively, each of said first and second side members including wall structure comprising, an intermediate wall portion having first and second leg wall components and a bight wall component interconnecting said first and second leg wall components and there being a recess defined by said first and second leg wall components and said bight wall component, an outer wall portion connected with said first leg wall component and adapted to lead adjacent to an outside face of a structural body, and an inner ledge wall portion adapted to lead adjacent to a space between first and second structural bodies, an end of said inner ledge wall portion forming a constricted entrance into said recess with said first leg wall component, and there being a bearing surface of said inner ledge wall portion set off across said constricted entrance from said first leg wall component of said intermediate wall portion; and said bridging and elastomeric sealing means including, bridging wall means supported by said first and second side members and forming a cavity with said first and second side members having said cavity communicate with said recesses through said constricted entrances, said bridging wall means having first and second end portions resting slidably upon said bearing surfaces of said inner ledge wall portions of said first and second side members, respectively, in said cavity, and said bridging wall means being covered by bond-inhibitor means in said cavity, and said bridging and elastomeric sealing means further comprising, anchor means connected with said bridging wall means and in said cavity, and an elastomeric sealing member molded and cured in said recesses and cavity and bonding said first and second side members together in said cavity and substantially filling said recesses and cavity, and embedding said anchor means in said cavity and anchoring to said first and second side members in said recesses through said constricted entrances while being inhibited against bonding to said bridging wall means in said cavity.

12. An expansion joint cover as set forth in claim 11 wherein said bond-inhibitor means extends outside said first and second end portions of said bridging wall means and inhibits bond of said elastomeric sealing member to said bearing surfaces of said inner ledge wall portions of said first and second side members.

13. An expansion joint cover as set forth in claim 11 wherein said bond-inhibitor means inhibits bond of said elastomeric sealing member at the bottom of said cavity to substantially flat surface areas of said bridging wall means on said first and second end portions of said bridging wall means and between said first and second end portions of said bridging wall means and said anchor means, and said bond-inhibitor means extends outside said first and second end portions of said bridging wall means and inhibits bond of said elastomeric sealing member to said bearing surfaces of said inner ledge wall portions of said first and second side members.

14. An expansion joint cover as set forth in claim 13 wherein said anchor means is connected with said bridging wall means generally centrally laterally of said bridging wall means and in reach, anchoringly, terminates inwardly laterally of said bridging wall means from opposite lateral ends of said bridging wall means.

15. An expansion joint cover as set forth in claim 14 wherein reach of said anchor means, anchoringly, laterally terminates along approximately the inner lateral one-third of said bridging wall means.

16. An expansion joint cover for sealing off a space between first and second structural bodies, said expansion joint cover comprising, first and second side members, and bridging and elastomeric sealing means, said first and second side members being adapted for being secured to first and second structural bodies, respectively, said first side member including wall structure comprising, an intermediate wall portion having first and second leg wall components and a bight wall component interconnecting said first and second leg wall components and there being a recess defined by said first and second leg wall components and said bight wall component, an outer wall portion connected with said first leg wall component and adapted to lead adjacent to an external surface of a first structural body, and an inner ledge wall portion having a substantially plane bearing surface adapted to be disposed substantially parallel to an external surface of at least the first of first and second structural bodies, and said inner ledge wall portion being adapted to lead adjacent to a space between first and second structural bodies, an end of said inner ledge wall portion forming a constricted entrance into said recess with said first leg wall component, and said substantially plane bearing surface of said inner ledge wall portion having said plane thereof intersecting said first leg wall component of said intermediate wall portion across said recess from said end of said inner ledge wall portion; and said bridging and elastomeric sealing means including, bridging wall means forming a cavity with said first and second side members having said cavity communicate with said recess through said constricted entrance, and an elastomeric sealing member in said cavity and said recess, said bridging wall means comprising substantially flat wall means and first and second end portions, said substantially flat wall means and said first end portion extending between said elastomeric sealing member and said bearing surface of said inner ledge wall portion of said first side member, having said first end portion slidably on said bearing surface of said inner ledge wall portion, and said second end portion supported by said second side member for said substantially flat wall means to be substantially parallel to said bearing surface of said inner ledge wall portion, and said bridging wall means, and said bearing surface of said inner ledge wall portion outside said first end portion of said bridging wall means, being covered by bond-inhibitor means in said cavity, and said bridging and elastomeric sealing means further comprising, anchor means connected with said substantially flat wall means and disposed in said cavity, and said elastomeric sealing member being molded and cured in said recess and cavity and bonding said first and second side members together in said cavity and substantially filling said recess and cavity, and embedding said anchor means in said cavity and anchoring to said first side member in said recess through said constricted entrance while being inhibited against bonding to said bridging wall means and said bearing surface of said inner ledge wall portion outside said first end portion of said bridging wall means in said cavity.

17. An expansion joint cover as set forth in claim 16 wherein said second side member and said second end portion of said bridging wall means are engaged for said bridging wall means to move with said second side member and be supported by said second side member while said first end portion of said bridging wall means moves slidably upon said bearing surface of said inner ledge wall portion of said first side member.

18. An expansion joint cover for sealing off a space between first and second structural bodies, said expansion joint cover comprising, first and second side members, and bridging and elastomeric sealing means, said first and second side members being adapted for being secured to first and second structural bodies, respectively, each of said first and second side members including wall structure comprising, an intermediate wall portion having first and second leg wall components and a bight wall component interconnecting said first and second leg wall components and there being a recess defined by said first and second leg wall components and said bight wall component, an outer wall portion connected with said first leg wall component and adapted to lead adjacent to an external surface of a structural body, and an inner ledge wall portion having a substantially plane bearing surface adapted to be disposed substantially parallel to external surfaces of first and second structural bodies, and said inner ledge wall portion being adapted to lead adjacent to a space between first and second structural bodies, an end of said inner ledge wall portion forming a constricted entrance into said recess with said first leg wall component, and said substantially plane bearing surface of said inner ledge wall portion having said plane thereof intersecting said first leg wall component of said intermediate wall portion across said recess from said end of said inner ledge wall portion; and said bridging and elastomeric sealing means including, bridging wall means forming a cavity with said first and second side members having said cavity communicate with said recesses through said constricted entrances, and an elastomeric sealing member in said cavity and said recesses, said bridging wall means comprising substantially flat wall means and first and second end portions, said substantially flat wall means and said first and second end portions extending between said elastomeric sealing member and said bearing surfaces of said inner ledge wall portions of said first and second side members, having said first and second end portions slidably on said bearing surfaces of said inner ledge wall portions, and said substantially flat wall means substantially parallel to said bearing surfaces of said inner ledge wall portions, and said bridging wall means, and said substantially plane bearing surfaces of said inner ledge wall portions outside said first and second end portions of said bridging wall means, being covered by bond-inhibitor means in said cavity, and said bridging and elastomeric sealing means further comprising, anchor means connected with said substantially flat wall means and disposed in said cavity, and said elastomeric sealing member being molded and cured in said recesses and cavity and bonding said first and second side members together in said cavity and substantially filling said recesses and cavity, and embedding said anchor means in said cavity and anchoring to said first and second side members in said recesses through said constricted entrances while being inhibited against bonding to said bridging wall means and said bearing surfaces of said inner ledge wall portions of said first and second side members outside said first and second end portions of said bridging wall means in said cavity.

* * * * *